US006352260B1

(12) United States Patent
Santiago

(10) Patent No.: US 6,352,260 B1
(45) Date of Patent: Mar. 5, 2002

(54) ROULETTE TABLE

(76) Inventor: William Santiago, 2711 E. Craig Rd., Suite H, North Las Vegas, NV (US) 89030

( * ) Notice: Subject to any disclaimer, the term of this patent is extended or adjusted under 35 U.S.C. 154(b) by 0 days.

(21) Appl. No.: 09/609,851

(22) Filed: Jul. 5, 2000

(51) Int. Cl.[7] ..... A63F 3/08
(52) U.S. Cl. ..... 273/274
(58) Field of Search ..... 273/274, 292

(56) References Cited

U.S. PATENT DOCUMENTS 5,098,107 A * 3/1992 Boylan et al. ..... 273/292
5,540,442 A * 7/1996 Orselli et al. ..... 463/17
5,636,838 A * 6/1997 Caro ..... 273/142 E

FOREIGN PATENT DOCUMENTS

GB 2063689 * 6/1981 ..... 273/274

* cited by examiner

*Primary Examiner*—Benjamin H. Layno
(74) *Attorney, Agent, or Firm*—Leonard Weiss

(57) ABSTRACT

A roulette table includes a wheel with thirty six pockets numbered one through thirty six, respectively, wherein a roulette ball may roll. Additionally, a roulette ladder on the table has thirty six boxes that are numbered one through thirty six, respectively. The boxes are arranged in twelve rows of three boxes wherein a red box is numbered on an elliptical field that is red and a black box is numbered on an elliptical field that is black. An equilateral parallelogram is formed by connecting elliptical fields of four black boxes that are distributed within three consecutive rows. Corners of the parallelogram are elliptical fields within the four black boxes. A player may make a black diamond bet that the roulette ball will roll into a pocket that has a number that is the same as a number of one of the four black boxes.

7 Claims, 1 Drawing Sheet

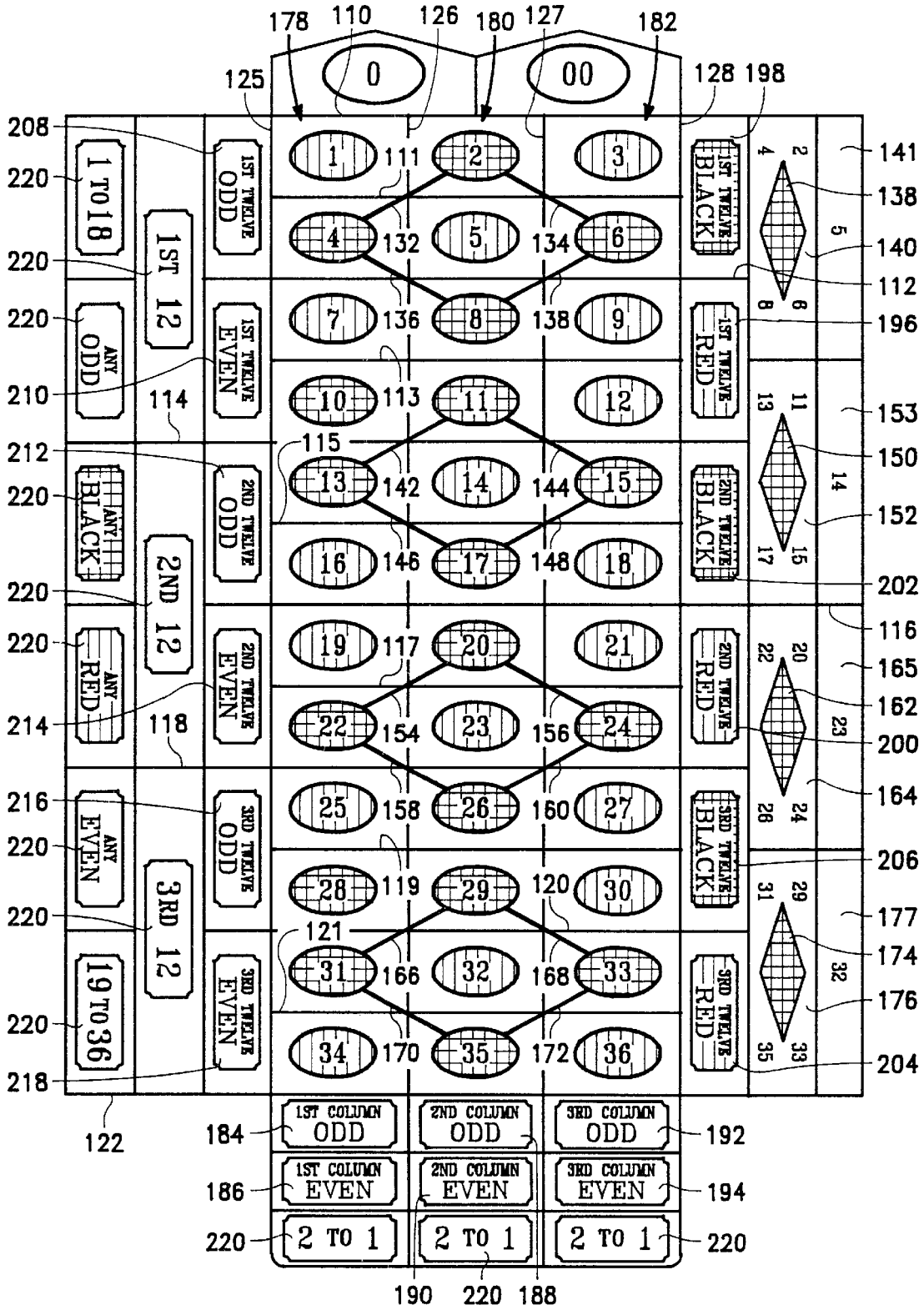
0
00
1 TO 18
1ST 12
ANY ODD
ANY BLACK
2ND 12
ANY RED
ANY EVEN
3RD 12
19 TO 36
1ST TWELVE ODD
1ST TWELVE EVEN
2ND TWELVE ODD
2ND TWELVE EVEN
3RD TWELVE ODD
3RD TWELVE EVEN
1ST TWELVE BLACK
1ST TWELVE RED
2ND TWELVE BLACK
2ND TWELVE RED
3RD TWELVE BLACK
3RD TWELVE RED
1ST COLUMN ODD
2ND COLUMN ODD
3RD COLUMN ODD
1ST COLUMN EVEN
2ND COLUMN EVEN
3RD COLUMN EVEN
2 TO 1
2 TO 1
2 TO 1

ROULETTE TABLE

BACKGROUND OF THE INVENTION

1. Field of Invention

This invention is in the general field of casino gaming and, more particularly, is a roulette game where a player may place any of an increased number of bets.

2. Description of the Prior Art

Roulette is a favorite gambling game of approximately nine million American women and four million American men. Typically, three of every five people seated at a roulette table are women.

The roulette table has embedded therein a bowl which is approximately thirty two inches in diameter. Around the rim of the bowl is a track that is approximately one inch wide and is slightly canted towards the interior of the bowl. At an outer edge of the track there is a wall that is approximately one inch high.

A roulette wheel head is rotatably mounted within the bowl. The wheel head and the track are concentric. A top outer edge of the wheel head is proximal to an inner edge of the track. The wheel head is slowly axially rotated by a motor.

The wheel head has thirty eight evenly spaced pockets along its outer edge. Thirty six of the pockets are marked with numbers one through thirty six, respectively. Each of the thirty six pockets are colored either red or black with the number of pockets colored red (eighteen) equalling the number of pockets colored black. Additionally, two uncolored pockets are marked 0 and 00, respectively. 0 and 00 are referred to as signs.

A croupier releases a small ball in a manner that propels it along the track in a direction opposite from the direction of rotation of the wheel head. Because of the wall, the ball is prevented from moving beyond the outer edge of the track. Because the track is canted, the ball rolls into one of the pockets when its motion is slowed by naturally occurring forces of friction along the track.

A player may bet that the ball will roll into a selected one of the pockets. Alternatively, the player may bet that the ball will roll into one pocket of a selected group of pockets. An interesting feature of roulette is that the casino's advantage is 5.26% for any bet. In other words, for every one hundred dollars that is bet, the casino will, statistically, net five dollars and twenty six cents.

To provide for the betting, the table carries an imprint of what is known as a roulette ladder. The ladder has twelve steps with three boxes on each step. Therefore, the ladder has a total of thirty six boxes.

The boxes are numbered from left to right and top to bottom of the ladder. Upon a top step of the ladder, for example, are boxes numbered one, two and three. On a next lower step of the ladder are boxes numbered four, five and six.

Boxes one, two and three are numbered upon elliptical fields that are colored red, black and red, respectively,—the same colors of pockets numbered one, two and three. Boxes four, five and six are numbered upon elliptical fields that are colored black, red and black, respectively,—the same colors of pockets numbered four, five and six.

In a similar manner, boxes on all other steps are numbered upon fields that are colored. When a box is numbered upon an elliptical field that is red, it is referred to as a red box. Correspondingly, when a box is numbered upon an elliptical field that is black it is referred to as a black box. In further amplification of the explanation given hereinbefore, the colors of boxes and pockets are in accordance with the following table.

| Box and Pocket Number | Color |
|---|---|
| 1, 3, 5, 7, 9, 12, 14, 16, 18, 19, 21, 23, 25, 27, 30, 32, 34, 36 | RED |
| 2, 4, 6, 8, 10, 11, 13, 15, 17, 20, 22, 24, 26, 28, 29, 31, 33, 35 | BLACK |

When, for example, the player wants to make a single pocket bet that the ball will roll into the pocket marked with the number, one, the player places a cheque upon the box marked with the number, one. Above the top step is an imprint of a box with a marking of the sign, 0, and an imprint of a box with a marking of the sign, 00. The player makes a single pocket bet that the ball will roll into the pocket marked with either the sign, 0, or the sign, 00, in a manner similar to the making of the single pocket bet described hereinbefore. The casino makes a thirty five to one payout when the player wins the single pocket bet.

The player may choose to make a colored pocket bet that the ball will roll into a red pocket or the colored pocket bet that the ball will roll into a black pocket. The casino makes a one to one payout when the player wins the colored pocket bet.

The player may choose to make an odd-even bet that the ball will roll into an odd numbered pocket or make the odd-even bet that the ball will roll into an even numbered pocket. The casino makes a one to one payout when the player wins the odd-even bet.

The player may make an eighteen pocket bet that the ball will roll into a pocket numbered one through eighteen or make the eighteen pocket bet that the ball will roll into a pocket numbered nineteen through thirty six. The casino makes a one to one payout when the player wins the eighteen pocket bet.

The player may make any of four twelve pocket bets. A first twelve pocket bet is that that the ball will roll into any one of the pockets numbered one through twelve. A second twelve pocket bet is that the ball will roll into any one of the pockets numbered thirteen through twenty four. A third twelve pocket bet is that the ball willroll into any one of the pockets numbered twenty five through thirty six. A fourth twelve pocket is bet that the ball will roll into a pocket having a number that appears in a selected one of three columns of twelve boxes of the roulette ladder. The casino makes a two to one payout when the player wins the twelve pocket bet.

Interest in a game is often predicated upon the number of different types of bets that can be made by the player. Heretofore, there has not been an increase in the types of bets in roulette where the 5.26% casino advantage is maintained.

SUMMARY OF THE INVENTION

An object of the present invention is to define heretofore unknown roulette bets where the 5.26% casino advantage is maintained.

According to the present invention, a roulette table has an imprint of a roulette ladder where black fields of four numbers are connected together by an imprint of four lines to form an equilateral parallelogram with one of the fields at each of its corners. A black diamond bet that a roulette ball will roll into a pocket that has a number that is the same as one of the four numbers is made by placing a cheque upon a proscribed symbol imprinted on the roulette table.

In further accord with the invention, a twelve black bet that the ball will roll into a pocket that has a number that is the same as a number of a black colored box in a specified group of twelve boxes on the roulette ladder is made by placing a cheque upon a proscribed betting icon imprinted on the roulette table. A twelve red bet that the ball will roll into a pocket that has a number that is the same as a number of a red colored box in the specified group of twelve boxes is made by placing a cheque upon a proscribed betting icon imprinted on the roulette table.

In further accord with the invention, a twelve odd bet that the ball will roll into a pocket that has a number that is the same as an odd number of a box in a specified group of twelve boxes on the roulette ladder is made by placing a cheque upon a proscribed betting icon imprinted on the roulette table. A twelve even bet that the ball will roll into a pocket that has a number that is the same as an even number of a box in the specified group of twelve boxes is made by placing a cheque upon a proscribed betting icon imprinted on the roulette table.

Other objects, features, and advantages of the invention should be apparent from the following description of the preferred embodiment thereof as illustrated in the accompanying drawing.

BRIEF DESCRIPTION OF THE DRAWING

The sole FIGURE herein is plan view of the top of a roulette table that carries an imprint of a roulette ladder with betting icons and symbols in accordance with the present invention.

DESCRIPTION OF THE PREFERRED EMBODIMENT

As shown in the drawing, a roulette table of a type used in a casino has an imprint of a roulette ladder having horizontal evenly spaced steps 110–122 with the step 110 being a top step. The steps 110–122 are intersected by vertical evenly spaced members 125–128 to define thirty six similar rectangular boxes with the member 125 being the leftmost member. The steps 114, 120 and the vertical members 126, 127 are shown as broken lines for reference number placement purposes only.

The steps 110–122 and the vertical members 125–128 define the thirty six boxes in three columns of twelve boxes. Numbers and colors of the boxes is in accordance with the prior art.

In the drawing, a black elliptical field is indicated with crosshatched lines; a red elliptical field is indicated with vertical lines.

On the roulette ladder, a black box numbered two has its elliptical field connected to elliptical fields of the black boxes numbered four and six by an imprint of lines 130, 132, respectively. The black box numbered two is in a first row of boxes of the roulette ladder. The black boxes numbered four and six are in a second row of boxes of the roulette ladder.

A black box numbered eight has its elliptical field connected to elliptical fields in the black boxes numbered four and six by imprints of lines 134, 136, respectively. The black box numbered eight is in a third row of the roulette ladder.

The lines 130, 133, 134, 136 form an equilateral parallelogram. Moreover, the equilateral parallelogram is on three successive rows of the roulette ladder.

A rhomboid 138 is within a rectangle 140 that includes a portion of the step 110 as one of its boundaries. The numerals two and four are imprinted proximal to one apex of the rhomboid 138; the numerals six and eight are imprinted proximal to an opposite apex. Because of the imprinted numerals, the rhomboid 138 is associated by a player with boxes numbered two, four, six and eight.

The player makes a first black diamond bet by placing a cheque upon the rhomboid 138. The player wins the first black diamond bet when a roulette ball (not shown) rolls into a pocket (not shown) that has either the number two, four, six or eight.

As explained hereinafter, there are four possible black diamond bets. The player receives an eight to one payout by winning a black diamond bet. Like almost all other roulette bets, the house has a 5.26% advantage when the player makes the black diamond bet.

Preferably, a rectangle 141 shares a boundary with the rectangle 140. The rectangle 141 has the number, 5, imprinted therein. In response to winning the first black diamond bet, the player is given an option of making a first jackpot bet of a predetermined amount that the ball will roll into the pocket numbered five after its next release.

The first jackpot bet is made by placing cheques representative of the predetermined amount within the rectangle 153. In response to winning the first jackpot bet, the player receives a jackpot payout from the casino.

On the roulette ladder, a black box numbered eleven has its elliptical field connected to elliptical fields of the black boxes numbered thirteen and fifteen by an imprint of lines 142, 144, respectively. The black box numbered eleven is in a fourth row of boxes of the roulette ladder. The black boxes numbered thirteen and fifteen are in a fifth row of boxes of the roulette ladder.

A black box numbered seventeen has its elliptical field connected to elliptical fields in the black boxes numbered thirteen and fifteen by imprints of lines 146, 148, respectively. The black box numbered seventeen is in a sixth row of boxes of the roulette ladder.

The lines 142, 144, 146, 148 form an equilateral parallelogram, Moreover, the equilateral parallelogram is on three successive rows of the roulette ladder.

A rhomboid 150 is within a rectangle 152 that shares a boundary with the rectangle 140. Numerals eleven and thirteen are imprinted proximal to one apex of the rhomboid 150; numerals fifteen and seventeen are imprinted proximal to an opposite apex. The player makes a second black diamond bet by placing a cheque upon the rhomboid 150. The player wins the second black diamond bet when the ball rolls into a pocket that has either the number eleven, thirteen, fifteen or seventeen.

Preferably, a rectangle 153 shares a boundary with the rectangle 152. The rectangle 153 has the number, 14, imprinted therein. In response to winning the second black diamond bet, the player is given an option of making a second jackpot bet of the predetermined amount that the ball will roll into the pocket numbered fourteen after its next release.

The second jackpot bet is made by placing cheques representative of the predetermined amount within the rectangle 153. In response to winning the second jackpot bet, the player receives the jackpot payout.

On the roulette ladder, a black box numbered twenty has its elliptical field connected to elliptical fields of the black boxes numbered twenty two and twenty four by an imprint of lines 154, 156, respectively. The black box numbered twenty is in a seventh row of boxes of the roulette ladder. The black boxes numbered thirteen and fifteen are in an eighth row of boxes of the roulette ladder.

A black box numbered twenty six has its elliptical field connected to elliptical fields in the black boxes numbered twenty two and twenty four by imprints of lines 158, 160, respectively. The black box numbered twenty six is in a ninth row of boxes of the roulette ladder.

The lines 154, 156, 158, 160 form an equilateral parallelogram. Moreover, the equilateral parallelogram is on three successive rows of the roulette ladder.

A rhomboid 162 is within a rectangle 164 that shares a boundary with the rectangle 152. Numerals twenty and twenty two are imprinted proximal to one apex of the rhomboid 162; numerals twenty four and twenty six are printed proximal to an opposite apex. The player makes a third black diamond bet by placing a cheque upon the rhomboid 162. The player wins the third black diamond bet when the ball rolls into a pocket that has either the number twenty, twenty two, twenty four or twenty six.

Preferably, a rectangle 165 shares a boundary with the rectangle 164. The rectangle 165 has the number, 23, imprinted therein. In response to winning the third black diamond bet, the player is given an option of making a third jackpot bet of the predetermined amount that the ball will roll into the pocket numbered twenty three on its next release.

The third jackpot bet is made by placing cheques representative of the predetermined amount within the rectangle 177. In response to winning the third jackpot bet, the player receives the jackpot payout.

On the roulette ladder, a black box numbered twenty nine has its elliptical field connected to elliptical fields of the black boxes numbered thirty one and thirty three by an imprint of lines 166, 168, respectively. The black box numbered twenty nine is in a tenth row of boxes of the roulette ladder. The black boxes numbered thirty one and thirty three are in an eleventh row of boxes of the roulette ladder.

A black box numbered thirty five has its elliptical field connected to elliptical fields in the black boxes numbered thirty one and thirty three by imprints of lines 170, 172, respectively. The black box numbered thirty five is in a twelfth row of boxes of the roulette ladder.

The lines 166, 168, 170, 172 form an equilateral parallelogram. Moreover, the equilateral parallelogram is on three successive rows of the roulette ladder.

A rhomboid 174 is within a rectangle 176 that shares a boundary with the rectangle 164. Numerals twenty nine and thirty one are imprinted proximal to one apex of the rhomboid 174; numerals thirty three and thirty five are imprinted proximal to an opposite apex. The player makes a fourth black diamond bet by placing a cheque upon the rhomboid 174. The player wins the fourth black diamond bet when the ball rolls into a pocket that has either the number twenty nine, thirty one, thirty three or thirty five.

Preferably, a rectangle 177 shares a boundary with the rectangle 176. The rectangle 177 has the number, 32, imprinted therein. In response to winning the fourth black diamond bet, the player is given an option of making a fourth jackpot bet of the predetermined amount that the ball will roll into the pocket numbered thirty two on its next release.

The fourth jackpot bet is made by placing cheques representative of the predetermined amount within the rectangle 177. In response to winning the fourth jackpot bet, the player receives the jackpot payout.

The thirty six boxes of the roulette ladder are arranged in three columns of twelve boxes. A first column 178 includes the boxes numbered one, four, seven, ten, thirteen, sixteen, nineteen, twenty two, twenty five, twenty eight, thirty one and thirty four. A second column 180 includes the boxes numbered two, five, eight, eleven, fourteen, seventeen, twenty, twenty three, twenty six, twenty nine, thirty two and thirty five. A third column 182 includes the boxes numbered three, six, nine, twelve, fifteen, eighteen, twenty one, twenty four, twenty seven, thirty, thirty three and thirty six.

The player makes an odd number first column bet by placing a cheque upon a betting icon 184 wherein a term, 1st column odd, is imprinted. The player wins the odd number first column bet when the ball rolls into a pocket having a number that is the same as an odd number of a box in the column 178.

The player makes an even number first column bet by placing a cheque upon a betting icon 186 wherein a term, 1st column even, is imprinted. The player wins the even number first column even bet when the ball rolls into a pocket having a number that is the same as an even number of a box in the column 178.

The player makes an odd number second column bet by placing a cheque upon a betting icon 188 wherein a term, 2nd column odd, is imprinted. The player wins the odd number second column bet when the ball rolls into a pocket having a number that is the same as an odd number of a box in the column 180.

The player makes an even number second column bet by placing a cheque upon a betting icon 190 wherein a term, 2nd column even, is imprinted. The player wins the even number second column bet when the ball rolls into a pocket having a number that is the same as an even number of a box in the column 180.

The player makes an odd number third column bet by placing a cheque upon a betting icon 192 wherein a term, 3rd column odd, is imprinted. The player wins the odd number third column bet when the ball rolls into a pocket having a number that is the same as an odd number of a box in the column 182.

The player makes an even number third column bet by placing a cheque upon a betting icon 194 wherein a term, 3rd column even, is imprinted. The player wins the even number third column bet when the ball rolls into a pocket having a number that is the same as an even number of a box in the column 182. There is a five to one casino payout when the player wins either an odd or even number column bets. It should be understood that the casino has a 5.26% advantage when the player makes either an odd or even column bet.

Of a first group of twelve boxes numbered one through twelve, boxes one, three, five, seven, nine and twelve are red; boxes two, four, six, eight, ten and eleven are black. The player places a cheque upon a betting icon 196 to make a first twelve red bet that the ball will roll into a pocket having a number that is the same as the number of a red box in the first group of twelve. The icon 196 has the words, 1st twelve red, imprinted therein.

The player places a cheque upon a betting icon 198 to make a first twelve black bet that the ball will roll into a pocket having a number that is the same as a number of a black box of the first group of twelve. The icon 198 has the words, 1st twelve black, imprinted therein.

Of a second group of twelve boxes numbered thirteen through twenty four, boxes fourteen, sixteen, eighteen, nineteen, twenty one and twenty three are red; boxes thirteen, fifteen, seventeen, twenty, twenty two and twenty four are black. The player places a cheque upon a betting icon 200 to make a second twelve red bet that the ball will roll into a pocket having a number that is the same as a number of a red box of the second group of twelve. The icon 200 has the words, 2nd twelve red imprinted therein.

The player places a cheque upon a betting icon 202 to make a second twelve black bet that the ball will roll into a pocket having a number that is the same as a number of a black box of the second group of twelve. The icon 202 has the words, 2nd twelve black, imprinted therein.

Of a third group of twelve boxes numbered twenty five through thirty six, boxes twenty five, twenty seven, thirty, thirty two, thirty four and thirty six are red; boxes twenty six, twenty eight, twenty nine, thirty one, thirty three and thirty five are black. The player places a cheque upon a betting icon 204 to make a third twelve red bet that the ball will roll into a pocket having a number that is the same as a number of a red box of the third group of twelve. The icon 204 has the words, 3nd twelve red imprinted therein.

The player places a cheque upon a betting icon 206 to make a third twelve black bet that the ball will roll into a pocket having is a number that is the same as a number of a black box of the second group of twelve. The icon 206 has the words, 3rd twelve black, imprinted therein.

When the player wins either a twelve red or a twelve black bet, the casino makes a five to one payout. The casino has a 5.26% advantage when the player makes either a twelve red or a twelve black bet.

Of the first group of twelve boxes, the player places a cheque upon a betting icon 208 to make a first twelve odd bet that the ball will roll into a pocket having a number which is the same as that of an odd numbered box of the first group of twelve. The icon 208 has the words, 1st twelve odd, imprinted therein.

The player places a cheque upon a betting icon 210 to make a first twelve even bet that the ball will roll into a pocket having a number which is the same as that of an even numbered box of the first group of twelve. The icon 210 has the words, 1st twelve even, imprinted therein.

Of the second group of twelve boxes, the player places a cheque upon a betting icon 212 to make a second twelve odd bet that the ball will roll into a pocket having a number which is the same that of an odd numbered box of the second group of twelve. The icon 212 has the words, 2nd twelve odd imprinted therein.

The player places a cheque upon a betting icon 214 to make a second twelve even bet that the ball will roll into a pocket having a number which is the same as that of an even numbered box of the second group of twelve. The icon 214 has the words, 2nd twelve even, imprinted therein.

The player places a cheque upon a betting icon 216 to make a third twelve odd bet that the ball will roll into a pocket having a number which is the same as that of an odd numbered box of the third group of twelve. The icon 216 has the words, 3nd twelve odd imprinted therein.

The player places a cheque upon a betting icon 218 to make a third twelve even bet that the ball will roll into a pocket having a number which is the same as that of an even numbered box of the third group of twelve. The icon 218 has the words, 3rd twelve even, imprinted therein. When the player wins either a twelve odd or a twelve even bet, the casino makes a five to one payout. The casino has a 5.26% advantage when the player makes either a twelve odd or a twelve even bet.

Additionally shown are a plurality of betting icons 220 that are used for placing bets in accordance with the prior art.

The above-described preferred embodiment is an example of an implementation of the invention and that various substitutions and modifications may be made therein without departing from the spirit and scope of the invention.

I claim:

1. In the method of playing a roulette game that utilizes a roulette table whereon a roulette wheel has thirty eight pockets wherein a roulette ball may roll after having been released, thirty six of the pockets carrying an imprint of numbers one through thirty six, respectively, the roulette table having an imprint of a roulette ladder with thirty six similar boxes numbered one through thirty six, respectively, arranged in twelve rows of three boxes wherein a red box is numbered upon an elliptical field therein that is red and a black box is numbered upon an elliptical field therein that is black, the improvement comprising the steps of:

connecting together elliptical fields within four black boxes distributed in three consecutive rows with imprints of lines to form an equilateral parallelogram, the elliptical fields within the four black boxes being at respective corners of the parallelogram;

providing on the roulette table an imprint of a proscribed symbol where a player makes a black diamond bet that the roulette ball will roll into a pocket having a number that is the same as the number of one of the four black boxes; and making a payout to the player when the player wins the black diamond bet.

2. The method of claim 1 wherein said proscribed symbol is a rhomboid.

3. In the method of claim 1, the additional step of giving the player an option of making a jackpot bet of a predetermined amount in response to the player winning the black diamond bet, the jackpot bet being that the ball will roll into a designated pocket after its next release, the player recieving a jackpot payout in response to winning the jackpot bet.

4. In the method of claim 1, the improvement comprising the additional steps of:

permitting the player to make a bet that the roulette ball will roll into a pocket having a number that is the same as an odd numbered box in a group of twelve boxes that have an equal number of odd and even numbered boxes; and permitting the player to make a bet that the roulette ball will roll into a pocket having a number that is the same as an even numbered box in said group of twelve boxes.

5. In the method of claim 4 wherein said boxes are arranged in three columns of twelve boxes and said group of twelve boxes includes all boxes in a column.

6. In the method of claim 1, the improvement comprising the additional steps of:

permitting the player to make a bet that the roulette ball will roll into a pocket having a number that is the same as a number of a red box in a group of twelve boxes that have an equal number of red and black boxes; and permitting the player to make a bet that the roulette ball will roll into a pocket having a number that is the same as a number of one of the black boxes of said group.

7. In the method of claim 6 wherein the roulette ladder includes three columns of twelve boxes and said group of twelve boxes includes all boxes in a column.

* * * * *